United States Patent [19]

Volkmann

[11] 4,027,890

[45] June 7, 1977

[54] SKATEBOARD WITH BRAKE

[76] Inventor: Adolf Volkmann, 4614 SE. Yamhill St., Portland, Oreg. 97215

[22] Filed: Apr. 12, 1976

[21] Appl. No.: 676,377

[52] U.S. Cl. ..... 280/11.2; 188/2 R; 188/29; 280/87.04 A

[51] Int. Cl.[2] ..... A63C 17/14

[58] Field of Search ..... 280/11.2, 87.04 A, 11.1 R, 280/11.19; 188/29, 2 R

[56] References Cited

UNITED STATES PATENTS

| | | | |
|---|---|---|---|
| 430,006 | 6/1890 | Dorr | 280/11.2 |
| 1,050,490 | 1/1913 | Schwarz | 280/11.2 |
| 1,517,352 | 12/1924 | Foote | 280/11.2 |
| 2,051,762 | 8/1936 | Vincent | 280/87.04 R |
| 2,173,716 | 9/1939 | Gurleay | 280/11.2 |
| 2,766,994 | 10/1956 | Ayers | 280/87.01 |
| 3,288,251 | 11/1966 | Sakwa | 280/11.2 X |
| 3,385,608 | 5/1968 | Waddell | 280/11.2 |
| 3,630,540 | 12/1971 | Smith | 280/87.04 A |
| 3,945,655 | 3/1976 | Banks et al. | 280/11.2 |

*Primary Examiner*—Joseph F. Peters, Jr.
*Assistant Examiner*—Milton L. Smith
*Attorney, Agent, or Firm*—Eugene M. Eckelman

[57] ABSTRACT

A pair of upright post-like brake shoes extend down through apertures in a skateboard body member in slidable relation directly over a pair of the wheels, and the shoes are secured at their upper ends to a top cross plate arranged to be pushed downwardly by the skateboard operator to move the bottom ends of the shoes into engagement with the surface of the wheels for applying the brakes. A resilient retracting member holds the brake shoes normally above the wheels in a nonbraking position.

6 Claims, 3 Drawing Figures

SKATEBOARD WITH BRAKE

BACKGROUND OF THE INVENTION

This invention relates to new and useful improvements in a skateboard with a brake mechanism.

As is well known, skateboards are the cause of many and severe injuries since they are extremely free rolling, particularly with the latest improvement in plastic wheels, and also since there is no efficient way to stop except to jump off. At high speeds, it is not possible to jump off without injury and thus the fast rides are the cause of severe accidents.

Attempts have heretofore been made to apply brakes to skateboards but such brake mechanisms have been complex in their structural arrangements and have been difficult to apply to the board as well. Furthermore, prior brake mechanisms for this particular purpose have been difficult to operate.

SUMMARY OF THE INVENTION

According to the present invention, a skateboard brake is provided which overcomes the deficiences of prior devices, the primary intention of the invention being to make skateboards safer in their use.

A more particular object of the invention is to provide a skateboard having a novel structure wherein a pair of upright brake shoes extend slidably down through apertures in the body member directly over a pair of the wheels and a cross plate is secured to the upper ends of the brake shoes which is engageable by the operator's foot for moving the shoes down on top of the wheels to apply the braking function. Resilient retracting means are provided to normally hold the brake shoes above the wheels in a non-braking position.

The invention will be better understood and additional objects and advantages will become apparent from the following description taken in connection with the accompanying drawings.

DETAILED DECRIPTION OF A PREFERRED EMBODIMENT

Figure 1:
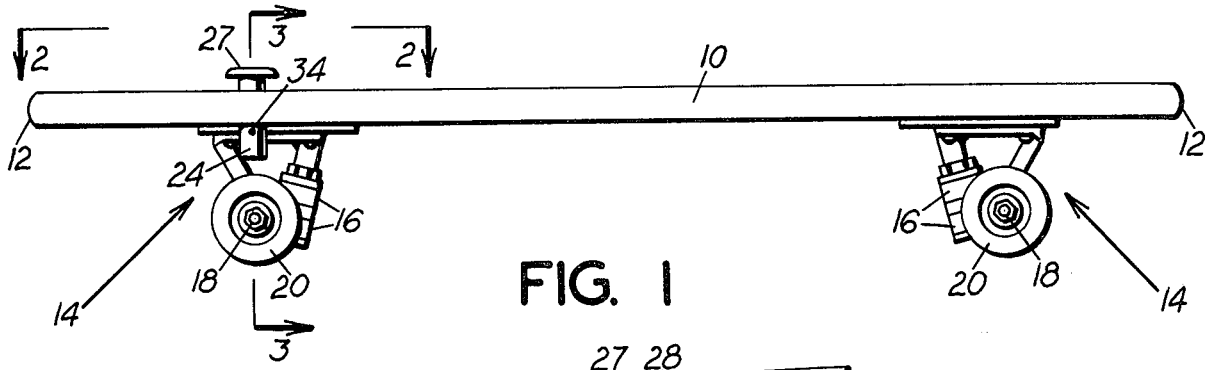
FIG. 1 is a side elevational view of a skateboard having a brake mechanism applied thereto in accordance with the concept of the present invention.
Figure 2:
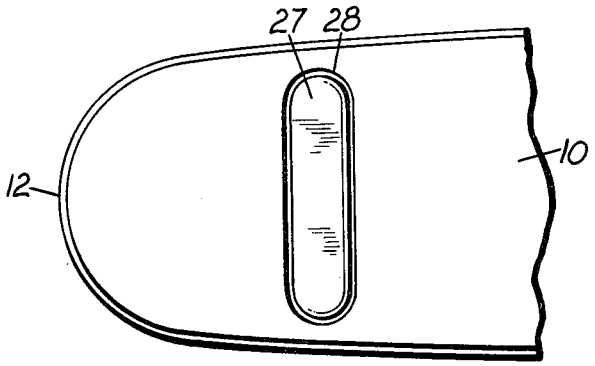
FIG. 2 is a fragmentary top plan view taken on the line 2—2 of FIG. 1.
Figure 3:
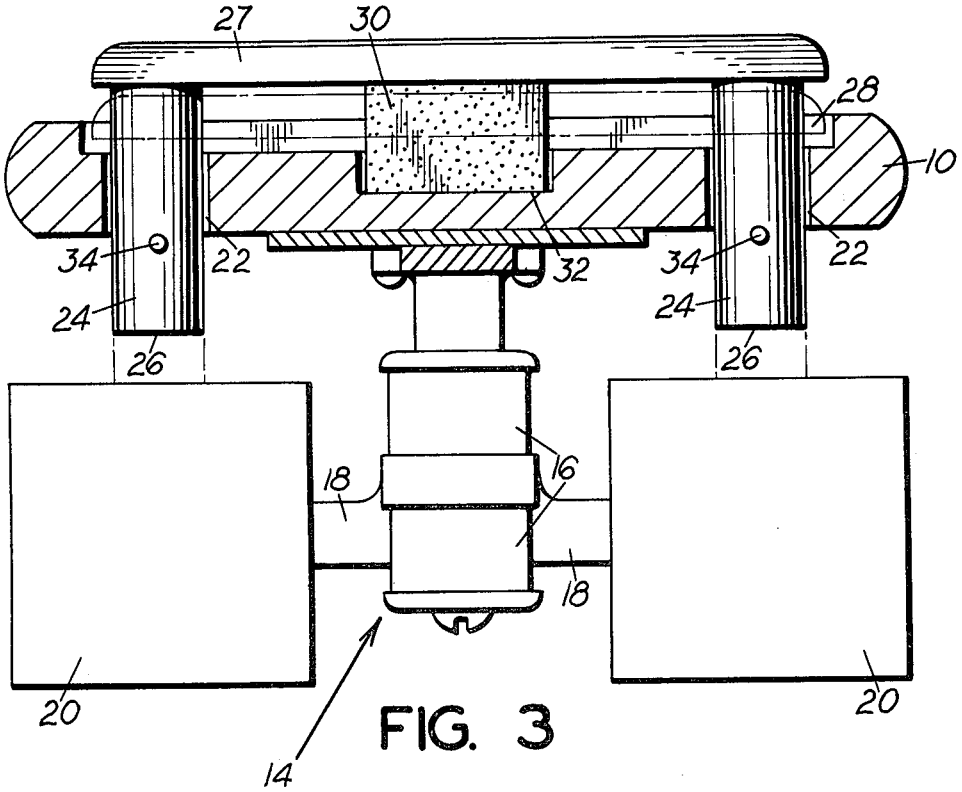
FIG. 3 is an enlarged cross sectional view taken on the line 3—3 of FIG. 1.

With particular reference to the drawings, the numeral 10 designates the body member of a skateboard of conventional construction. Such existing body members are plate-like in construction and are substantially elongated such that an operator can stand thereon. The ends 12 of the body member are rounded as shown or of course such ends may take any other desired shape.

Also according to conventional mechanisms, the body member 10 is supported by a pair of wheel assemblies or trucks 14 having a steerable, cushioning structure 16 for supporting an axle 18. The ends of the axle form spindles for a pair of wheels 20 generally constructed of a durable plastic such as urethane. In the usual instance, the entire wheel or at least a greater portion thereof is disposed inwardly from the side edges of the body member 10. The bottom surface of the body member is spaced above the tops of the wheels.

According to the present invention, the body member 10 is provided with a pair of apertures 22 directly over the axle 18, and these apertures receive post-like brake shoes 24 having bottom edges 26. The upper ends of the brake shoes are integral with a cross plate 27 which comprises a foot engaging member for use by the operator to move the brake shoes into engagement with the wheels. All the defining top edges of the cross plate 27 are rounded for easy movement of the operator's foot onto and off such plate.

A cross groove 28 is provided in the top of the body member 10 in order to provide adequate room for downward movement of the plate 27 in certain conditions, as will be more apparent hereinafter. Such groove is slightly larger in its side and end dimensions to provide free movement of the plate 27 into and out of it.

Disposed between the undersurface of plate 27 and the body member 10 is a resilient retracting member 30 arranged to support the plate 27 normally in an upper position. Such retracting member preferably comprises a block of resilient or sponge-like material such as a plastic foam or the like. The retracting block 30 may be seated in a groove 32 in the bottom of slot 28 for maintaining it in place and also may be adhesively secured in such groove. If the retracting means should become damaged or lost, it is merely necessary to insert another replacement block. Upward movement of the brake assembly is limited by keepers 34 such as cotter pins extending diametrically through the brake shoes 24 under the body 10. The brake assembly will normally remain in retracted position but is readily applied by a touch of the foot thereto.

When the brake is applied, the bottom ends of the brake shoes will engage the peripheral surface of the respective wheels. The friction engagement between the brake shoes and the wheels provides the braking function. Brake shoes 24 are preferably constructed of a durable material such as Nylon so as to have a long life.

The present brake assembly may be applied to either the front or rear wheel assembly or to both if desired. It will operate effectively even though the skateboard is in a turn in that even though the wheels are turned away from their straight across position, symmetrical engagement of the brake shoes on opposite sides of the wheels will be provided. That is, in such a turn, one brake shoe will engage its wheel in front of the axis of such wheel and the other brake shoe will engage its wheel rear of the axis of such wheel. In such a turn, the body member will be tipped laterally. When the operator depresses the cross plate at this time, the latter will engage both wheels and thus will be angled relative to the body member. The apertures 22 are enlarged diametrically relative to the shoes 24 to allow such angular positioning. A substantially equal braking force is thus applied to the two wheels. If the wheels are in a severe turn, the brake shoes nevertheless can engage them by extra downward movement of the cross plate 27 provided by groove 28, although it is apparent that without such a groove a higher clearance between the plate 27 and the top of the body member may simple be provided.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A skateboard comprising a. an elongated rigid body member having forward and rearward ends and also having top and bottom surfaces, b. wheel truck assemblies on the under side of said body member adjacent each end, c. each of said truck assemblies having a pair of wheels, d. a pair of upright brake shoes extending down through said body member in slidable relation adjacent at least one of said pair of wheels, e. said brake shoes having bottom ends arranged to engage the surfaces of respective wheels upon downward movement of said shoes, f. a foot engageable cross plate secured to the tops of said brake shoes and arranged to be pushed downwardly by the skateboard operator for moving said shoes down into engagement with the surface of said wheels in a braking function.

g. and resilient retracting means normally hoiding said brake shoes and above said wheels in non-braking position.

2. The skateboard of claim 1 wherein said brake shoes comprise post members.

3. The skateboard of claim 1 wherein said resilient retracting means is confined between said cross plate and said body member.

4. The skateboard of claim 1 wherein said resilient retracting means is confined between said cross plate and said body member and comprise a block of sponge-like material.

5. The skateboard of claim 1 including means defining a cross groove in the top surface of said body member arranged to receive said cross plate in the down brake applying position thereof.

6. The skateboard of claim 1 including keeper means in said brake shoes on the under side of said body member limiting upward movement of said brake shoes resulting from said retracting means.

* * * * *